United States Patent [19]

Vogelsang

[11] Patent Number: 4,522,523

[45] Date of Patent: Jun. 11, 1985

[54] ENAMEL TOUCH-UP KIT INCLUDING KNIFE BLADE

[75] Inventor: Kurt Vogelsang, Forch, Switzerland

[73] Assignee: Kurt Vogelsang GmbH, Hassmersheim, Fed. Rep. of Germany

[21] Appl. No.: 512,981

[22] Filed: Jul. 12, 1983

[30] Foreign Application Priority Data

Jul. 14, 1982 [DE] Fed. Rep. of Germany ..... 3226219

[51] Int. Cl.[3] ..... A64B 11/04; B65D 51/24

[52] U.S. Cl. ..... 401/126; 401/38; 401/130; 401/195

[58] Field of Search ..... 401/38, 129, 126, 16, 401/25, 195, 118, 130, 37

[56] References Cited

U.S. PATENT DOCUMENTS 938,667 11/1909 Holder ..... 401/195
2,869,162 1/1959 Dritz ..... 401/119 X

FOREIGN PATENT DOCUMENTS 2630351 10/1977 Fed. Rep. of Germany ..... 401/126
1136179 5/1957 France ..... 401/129
1219912 5/1960 France .
358031 12/1961 Switzerland ..... 401/118
2068217 8/1981 United Kingdom ..... 401/126

*Primary Examiner*—Steven A. Bratlie
*Attorney, Agent, or Firm*—Barnes & Thornburg

[57] ABSTRACT

An enamel or paint touch-up kit for paint repair, expecially on automobiles, is disclosed consisting of an enamel container with a screw cap, the base of a touch-up brush extending into the container being attached to this screw cap. Additionally, a rust-removing tool is provided which is mounted, with its base in opposition to the base of the brush, to the screw cap and projecting away from the screw cap in the opposite direction with respect to the brush, and being accommodated in a hollow space formed by a protective cap seated on the screw cap and enclosing the rust-removing tool on all sides. This arrangement has the advantage that the screw cap can still be used, as before, as a handle for operating the touch-up brush. For a rust-removing operation, it is merely necessary to remove the protective cap of the novel enamel touch-up stick so that the container then serves as a handle for manipulating the rust-removing tool with the same being fixedly joined to this handle.

12 Claims, 4 Drawing Figures

ENAMEL TOUCH-UP KIT INCLUDING KNIFE BLADE

BACKGROUND AND SUMMARY OF THE INVENTION

The invention relates to an enamel touch-up kit for paint repair, especially on automobiles, consisting of an enamel or paint container with a screw cap, the base of a touch-up brush extending into the container being attached to this screw cap. An additional rust-removing tool accommodated in a hollow space of the screw cap is provided which, after removal of a lid covering the hollow space, is accessible and usable.

It is known (French Pat. No. 1,219,912) to combine the screw caps of enamel touch-up kits with additional tools, for example in the form of spatulas, which are accommodated in a cylindrical cavity within the screw cap. These tools are firmly joined to a lid and thus can be utilized after removal of the lid. The cavity within the screw cap, which latter due to its elongated configuration also serves as a grip for handling the touch-up brush, also houses still other auxiliary means, such as, for example, a filling compound. One disadvantage resides in that auxiliary tools arranged in this way can be manipulated only with great difficulties on account of the relatively small lid.

Similar designs of enamel touch-up kits are known wherein in the same way a rust-removing brush is combined with the lid in place of a spatula (German Pat. No. 2,630,351). In this arrangement, the additional provision is made to retain the lid via laterally projecting tangs in slots along the rim of the cavity of the screw cap. The rust-removing brush can be withdrawn in this way and optionally can also be inserted in a reversed fashion in the end of the screw cap, so that the enamel touch-up stick itself can serve as the handle. However, these types of design have the drawback that the rust-removing tool, held in this way relatively loosely in slots, is not seated firmly enough on the screw cap and also can drop out of the mounting during its use. If the rust-removing brush is handled in the way it is manipulated also in the previously discussed type of arrangement, then the drawback arises that the end of the brush can be seized only by the relatively small lid part.

Therefore, the present invention is based on the object of constructing an enamel touch-up kit of the type described above in such a way that a controlled rust removal can be performed in a simple and thorough fashion prior to painting without impairing the touch-up enameling operation and the handling of the touch-up brush necessary for this purpose.

According to preferred embodiments of the invention, the rust-removing tool is mounted, with its base in opposition to the base of the touch-up brush, to the screw cap and projects in the opposite direction therefrom away from the screw cap; and the lid is fashioned as a protective cap forming the hollow space, this protective cap being seated on the screw cap and encompassing the rust-removing tool on all sides. This arrangement has the great advantage that the external shape of the screw cap and its configuration as a handle for manipulating the touch-up brush can be retained, but that merely the protective cap needs to be taken off for the rust-removing operation, so that then the entire enamel touch-up stick (container) serves as a handle for operating the rust-removing tool which tool is fixedly joined to this handle. Consequently, an effortless and controlled working with the rust-removal tool is made possible.

It is advantageous according to especially preferred embodiments to place the protective cap with its open rim onto a collar of the screw cap surrounding the base of the rust-removing tool, so that the protective cap can be readily pulled off to make the rust-removing tool accessible. To obtain the objective at the same time of being able to unscrew the screw cap from the container before beginning an enamel touch-up repair, it is advantageous to provide the protective cap and the collar with a polygon-type circumferential surface which takes care, on the one hand, of seating the protective cap secure from rotation on the actual screw portion of the screw cap, but, on the other hand, also forms a profiled outer surface suitable for the screw attachment, which surface can be readily seized.

It is advantageous according to especially preferred embodiments to provide that the rust-removing tool consists of a knife blade attached to a peg-like extention of the screw cap because in this way—as contrasted to the use of a rust-removal wire brush—a very much more controlled, localized rust removal is made possible, avoiding contact with the parts of the car body adjacent to the rust spot but not as yet attacked by rust. It is also advantageous to fashion the extension to be conical with the larger diameter on the side of the screw cap and to provide the knife blade with an inclined edge in the manner of an eraser blade. This arrangement makes it possible to apply the tool in a spotwise fashion.

It is advantageous from a manufacturing viewpoint to make the collar, the extension, and the mounting base for the touch-up brush of one piece with the screw cap. Such a screw cap can be produced in a simple way of a synthetic resin. The protective cap can also be made of a transparent material so that, after having been placed on the screw cap, the consumer can perceive the rust-removing tool held in the screw cap.

Further objects, features, and advantages of the present invention will become more obvious from the following description when taken in connection with the accompanying drawing which shows, for purposes of illustration only, a single embodiment in accordance with the present invention.

DETAILED DESCRIPTION OF THE DRAWING

Figure 1:
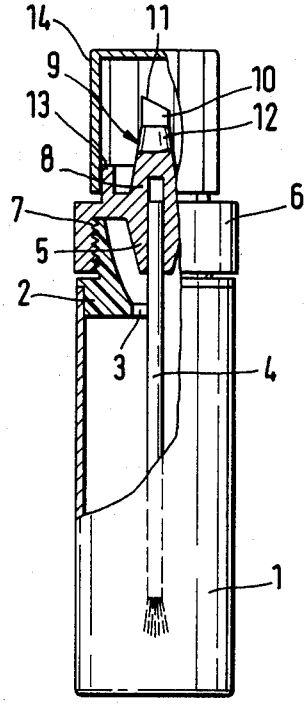
FIG. 1 is a partially cut-away lateral view of a novel enamel touch-up kit constructed in accordance with a preferred embodiment of the invention, in the sealed condition.
Figure 2:
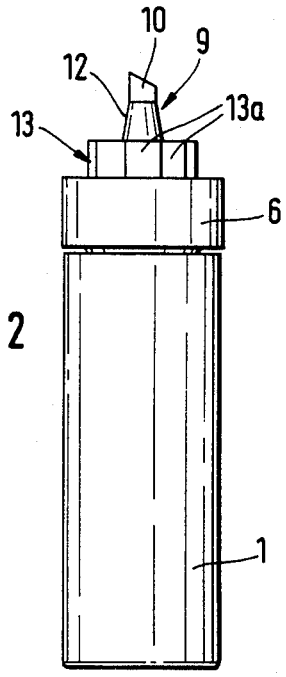
FIG. 2 shows the enamel touch-up kit of FIG. 1, but with the protective cap removed and the rust-removing tool ready for use.

In FIGS. 1 and 2, a cylindrical enamel touch-up or paint container 1 is illustrated, sealed toward the top by a sealing ring 2 consisting preferably of a synthetic resin. A touch-up paint brush 4 projects into the central opening 3 of this ring 2. In this embodiment, the touch-up paint brush is inserted with its top end into a base 5 at a screw cap 6, the cap 6 being tightly threaded on the outside onto a corresponding thread 7 of the closing ring 2. Oppositely to the base 5 for the touch-up brush 4, a base 8 for a rust-removing tool 9 is arranged integrally with the screw cap 6 at the cap 6. The rust-removing tool 9 projects away from the screw cap 6 in the opposite direction from the touch-up brush 4.

Figure 4:
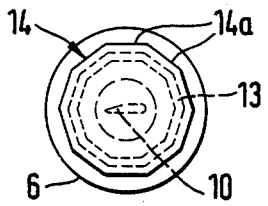
FIG. 4 shows a top view of the screw cap and protective cap of FIG. 3, taken in the direction of arrow IV in FIG. 3.

The rust-removing tool 9 consists in this embodiment of a knife blade 10 with an inclined edge 11 arranged fixedly at the upper end of a peg-shaped and slightly conically fashioned extension 12. At the base 8, the conical extension 12 exhibits its major diameter. Furthermore, a collar 13 surrounding the extension 12 is provided at the screw cap 6; as can be seen especially from FIGS. 2 and 4, this collar has a polygonal external shape and exhibits ten surfaces uniformly distributed along its circumference, extending in parallel to the axis of the touch-up brush 4 and having respectively a rectangular configuration. A protective cap 14 is attached to this collar 13 on the outside, this protective cap likewise having a polygon-shaped circumference and a corresponding inner periphery, with which it is clampingly attached to the polygonal surfaces 13*a* of the collar 13. The protective cap 14 is in this way held firmly at the screw cap 6 and surrounds the rust-removing tool 9 on all sides. Furthermore, the protective cap is non-rotationally attached to the screw cap 6 and in this way permits unscrewing of the screw cap 6 by grasping the outer surfaces 14*a* of the protective cap 14, these surfaces, in turn, forming a uniform polygon in top view (FIG. 4).

The novel enamel touch-up stick can be utilized as follows, based on its basic configuration illustrated in FIG. 1:

If first of all rust is to be removed from a specific location on an automobile body, the protective cap 14 is pulled off the collar 13 so that the enamel touch-up stick assumes the form shown in FIG. 2. Then the touch-up stick can be seized at the container 1 as the handle so that the knife blade 10 can be used for rust removal. Due to the inclined edge 11, a controlled rust removal restricted to specific locations can be performed so that, contrasted to removing the rust with the aid of a small wire brush, only the worked-on spot, but not neighboring, still enamel-coated spots, is affected. This rust-scraping operation can be performed very easily and simply due to the long handle form of the enamel touch-up stick with the container 1 and the protective cap 6. An advantage in this connection is provided by the feature that the rust-removing tool 9 itself is fixedly joined to the touch-up stick so that, if necessary, even relatively great forces can be applied in a controlled fashion.

Figure 3:
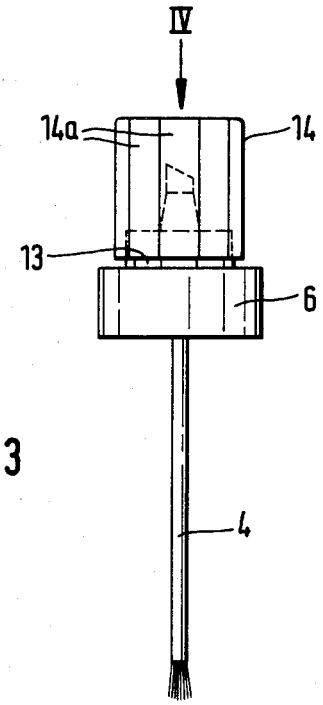
FIG. 3 shows the screw cap with protective cap attached thereto and with the touch-up brush ready for use for paint touch-up, of the touch-up kit of FIGS. 1 and 2.

Once the rust-removing process is completed, the protective cap 14 is reapplied and, with its aid, the screw cap 6 is removed from container 1 by rotating, so that it serves as a handle for the touch-up brush 4 in the form illustrated in FIG. 3; this touch-up brush can be dipped into the enamel present in the container 1 in a manner known per se and utilized for enamel touch-up. After the work has been completed, the screw cap 6 with the protective cap 14 is again threaded onto the container 1 so that the enamel touch-up stick resumes the initial position shown in FIG. 1.

An advantageous feature is the rugged connection of the rust-removing tool 9 with the entire enamel touch-up stick by way of the screw cap 6, this tool being integrally attachable to this screw cap.

While I have shown and described a single embodiment in accordance with the present invention, it is understood that the same is not limited thereto but is susceptible to numerous changes and modifications as would be known to those skilled in the art of the present disclosure and I therefore do not wish to be limited to the details shown and described therein but intend to cover all such changes and modifications as are encompassed by the scope of the appended claims.

What is claimed is:

1. Paint touch-up kit for repairing paint on automobiles and the like, comprising:

a touch-up paint container;

a screw cap for selectively closing and opening the container;

a touch-up brush;

a base of the brush being attached to the screw cap;

a removable lid covering a hollow space of the screw cap and engageable with a collar of said screw cap;

a rust-removing knife blade accommodated in the hollow space, which tool is accessible and usable upon removal of the lid;

wherein said knife blade is mounted to a peg-like extension of the screw cap with its base extending in opposition to the brush away from the screw cap; and wherein the lid is fashioned as a protective cap forming the hollow space, said lid being detachably attached to the screw cap and enclosing the tool on all sides.

2. Paint touch-up kit according to claim 1, wherein the lid is placed with its open rim on said collar of the screw cap, which collar surrounds the base of the tool.

3. Paint touch-up kit according to claim 1, wherein the protective cap and the collar are provided with circumferential surfaces arranged in polygon shape.

4. Paint touch-up kit according to claim 2, wherein the protective cap and the collar are provided with circumferential surfaces arranged in polygon shape.

5. Paint touch-up kit according to claim 1, wherein the peg-like extension is of a concial shape and has its major diameter in the zone of the base on the side of the screw cap.

6. Paint touch-up kit according to claim 5, wherein the knife blade has an inclined edge in the manner of an eraser blade.

7. Paint touch-up kit according to claim 1, wherein the knife blade has an inclined edge in the manner of an eraser blade.

8. Paint touch-up kit according to claim 5, wherein the collar, the extension, and the mounting base for the touch-up brush are manufactured integrally in one piece with the screw cap.

9. Paint touch-up kit according to claim 1, wherein the collar, the extension, and the mounting base for the touch-up brush are manufactured integrally in one piece with the screw cap.

10. Paint touch-up kit according to claim 1, wherein the protective cap is made of a transparent material.

11. Paint touch-up kit according to claim 1, wherein said protective cap is non-rotationally attached to said screw cap.

12. Paint touch-up kit for repairing paint on automobiles and the like, comprising:

a touch-up paint container;

a screw cap for selectively closing and opening the container;

a touch-up brush;

a base of the brush being attached to the screw cap;

a removable lid covering a hollow space of the screw cap and engageable with a collar of said screw cap;

a rust-removing knife blade accommodated in the hollow space, which tool is accessible and usable upon removal of the lid;

wherein said knife blade is mounted to a peg-like extension of the screw cap with its base extending in opposition to the brush away from the screw cap; and wherein the lid is fashioned as a protective cap forming the hollow space, said lid being detachably attached to the screw cap and enclosing the tool on all sides, and said protective cap and said collar being provided with mating circumferential surfaces arranged in polygon shape.

* * * * *